United States Patent [19]

Massey

[11] Patent Number: 4,839,871

[45] Date of Patent: Jun. 13, 1989

[54] UNDERWATER COMMUNICATION DEVICE

[76] Inventor: Auldin J. Massey, 3437 Binkley, Dallas, Tex. 75205

[21] Appl. No.: 215,364

[22] Filed: Jul. 5, 1988

[51] Int. Cl.[4] ..... H04R 1/02

[52] U.S. Cl. ..... 367/132; 367/172; 181/18; 381/151

[58] Field of Search ..... 181/18, 21, 22, 142, 181/402; 367/132, 167, 171, 172, 174, 175, 910, 131; 381/151, 194

[56] References Cited

U.S. PATENT DOCUMENTS

| | | | |
|---|---|---|---|
| 2,844,212 | 7/1958 | Hogan et al. | 181/18 |
| 3,320,578 | 5/1967 | Ahrens et al. | 367/165 |
| 3,548,371 | 12/1970 | Alexander | 367/141 |
| 3,670,299 | 6/1972 | Kahn | 367/175 |
| 3,993,973 | 11/1976 | Hutchins et al. | 367/172 |
| 4,070,110 | 1/1978 | Payne | 355/100 |
| 4,277,839 | 7/1981 | McKinney | 367/155 |

OTHER PUBLICATIONS

"University Sound", Engineering Notes and Specifications (4 pages); publication date unknown.

*Primary Examiner*—Brian S. Steinberger
*Attorney, Agent, or Firm*—John E. McRae

[57] ABSTRACT

An underwater speaker system having a pressure equalization system enabling the speaker to operate in its intended fashion over a wide range of water depths, e.g. from two feet up to sixty feet. Water pressure is applied to a diaphragm that forms one wall of a variable volume an internal face of a speaker membrane. Pressures are equalized on opposite faces of the membrane to enhance speaker performance.

6 Claims, 1 Drawing Sheet

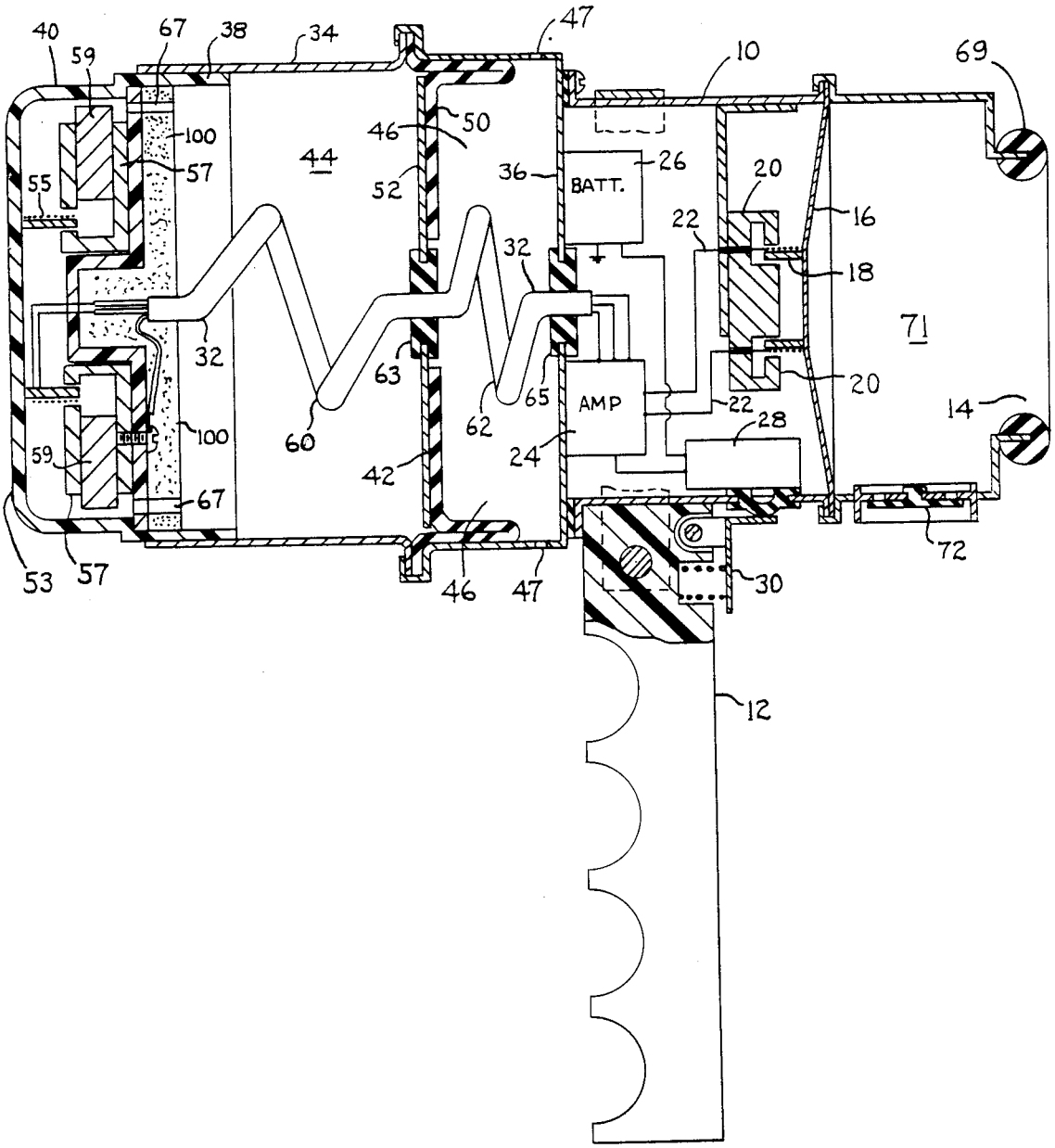
40
59
67
38
34
47
10
69
100
57
44
46
50
52
36
BATT.
26
20
16
55
22
18
32
71
63
65
AMP
22
28
14
60
62
24
42
59
100
67
53
57
46
47
30
72
12

UNDERWATER COMMUNICATION DEVICE

BACKGROUND OF INVENTION

U.S. Pat. No. 3,670,299 to I. Kahn discloses a loudspeaker usable underwater, e.g. in swimming pools. The present invention concerns an improvement on the device shown in the Kahn patent, whereby the speaker can be used to relatively great water depths, e.g. sixty feet or more.

I am unaware of any prior art speaker designed to be used over a range of water depths, e.g. near the water surface and also at great water depths, e.g. greater than about ten feet. High water pressures associated with great water depths tend to bias the speaker membrane from its normal position, thereby displacing the voice coil from its properly centered position in the magnetic air gap.

It is possible to modify the speaker construction shown in above-referenced U.S. Pat. No. 3,670,299 for operation at large water depths. The modification involves the addition of pressurized air to the speaker housing such that the zone behind the speaker membrane is pressurized to reinforce the membrane against the biasing effect of water pressure on the outer face of the membrane.

However, when this is done then the speaker will not operate properly at other water pressures (higher or lower than the water pressure corresponding to the charging air pressure). I am proposing a pressure-equalizing system that is effective (useful) at any water pressure (within limits of the system), whereby the speaker can be operated over a range of water pressures.

SUMMARY OF THE INVENTION

My invention relates to a chamber system incorporated into the loudspeaker housing whereby external water pressure is applied to one of the chambers; the pressure is transmitted to another chamber in the system. The other chamber (containing air) is contracted to apply a force on the internal face of the speaker membrane related to external water pressure.

My invention causes the pressures on opposite faces of the speaker membrane to be equalized, whatever the external water pressure happens to be. The speaker can thus be located (used) at varying underwater depths without adverse effect on speaker performance.

THE DRAWINGS

The single FIGURE of the drawing is a sectional view through an underwater communication device incorporating my invention.

DESCRIPTION OF A PREFERRED EMBODIMENT OF THE INVENTION

The drawing shows an underwater communication device comprising a housing structure 10 attached to a handle structure 12. In use, an underwater swimmer grasps handle 12 to hold housing structure 10 in front of his/her face. The swimmer can speak into end opening 14 in the housing structure. Sound waves are applied to a conventional microphone 16. Voice coil 18 moves back and forth in an air gap defined by permanent magnet 20. The electrical voltage induced in coil 18 is applied through lead wires 22 to amplifier 24. Battery 26 supplies electrical power to the amplifier via an on-off switch 28.

Switch 28 is turned to a circuit-closed condition by manual depression of a lever actuator 30; in the absence of thumb pressure on actuator 30 switch 28 is in an off (circuit-open) condition. Actuator 30 is depressed whenever the swimmer desires to speak into microphone 16. The amplifier 24 output is applied through lead wires to an insulated, flexible three-wire electrical cable 32.

Housing structure 10 includes a central tubular section 34 extending leftwardly from radial wall 36. The left end area of tubular section 34 is sealably joined to axial wall 38 of speaker means 40. The speaker means is preferably constructed as shown in previously-mentioned U.S. Pat. No. 3,670,299 of J. Kahn.

A movable diaphragm 42 subdivides tubular section 34 into an air chamber 44 and water chamber 46. One or more openings 47 are provided in the side wall of tubular section 34 to admit water into chamber 46.

Diaphragm 42 may be constructed in various ways, e.g. in a bellows configuration or bellofram configuration. The two criteria are (1) that the diaphragm seal chamber 44 against inflow of water, and (2) that the diaphragm offer minimal resistance to movement, whereby the pressures in chambers 46 and 44 are essentially the same, i.e. equalized. The illustrated diaphragm includes a central rubber disk section 50 bonded to a metal plate 52. The diaphragm can move leftwardly to a point where plate 52 contacts the edge of wall 38.

Speaker means 40 is described in detail in U.S. Pat. No. 3,670,299. A primary component of the speaker means is a vibratable membrane 53 and associated voice coil 55 movable axially in an annular air gap defined by armature 57 and permanent magnet 59. Electrical energy is delivered to coil 55 through the aforementioned flexible cable 32. The left end of the cable 32 is encapsulated in a mass of epoxy sealant 100.

Flexible cable 32 extends within tubular section 34 between wall 36 and sealant mass 100. The cable includes a coiled section 60 within air chamber 44 and another coiled section 62 within water chamber 46. An intermediate section of the cable has a sealed connection with a rubber grommet 63 carried on diaphragm wall 52. The right end section of cable 32 has a sealed connection with rubber grommet 65 carried on housing wall 36.

Coiled sections 60 and 62 provide slack in cable 32, whereby diaphragm 42 is able to move freely without disturbing the sealed connection between grommet 63 and cable 32. The cable does not slide in grommet 63; the grommet tightly grips the sheath surface of the cable to maintain a sealed water-tight joint.

As diaphragm 42 is moved back and forth by changes in water pressure (in chamber 46) the volume of air in chamber 44 increases or decreases inversely in accordance with changes in water pressure.

Chamber 44 is initially at atmospheric pressure. As the water pressure increases diaphragm 42 moves to the left, thereby raising the pressure in chamber 44. This pressure is communicated to the inner (right) face of membrane 53 through one or more passages 67 in sealant mass 100. The effect of this action is to equalize the pressures on opposite faces of membrane 53, thereby eliminating the rightward bias that higher water pressures would otherwise have on the membrane. Coil 55 is thereby maintained in designed positions in the associated air gap over a wide range of water pressures, e.g. from a five foot water depth to a sixty foot water depth, or greater.

The right end area of housing structure 10 may be constructed as shown generally in U.S. Pat. No. 3,548,371 to D. Alexander. The swimmer's face area is pressed against annular seal 69; the swimmer then blows air into chamber 71 to expel water through check valves 72. He or she is then able to speak into microphone 16. The resultant electrical signal is amplified and passed through cable 32 to speaker 40.

My invention is concerned primarily with the pressure-equalization means provided by housing section 34 and diaphragm 42. The drawing shows one specific form that the invention can take. It will be appreciated that other forms are possible.

I claim:

1. An underwater personal communication device comprising:

a housing structure (10) having a first end and a second end; a rigid wall (36) located within the housing structure at an intermediate point between its ends;

an electrical microphone means (16) located in the first end of the housing structure adjacent one face of said rigid wall;

an electrical speaker means located in the second end of the housing structure, said speaker means including a vibratable membrane (53) having an inner surface and an outer surface exposed to underwater pressure;

a movable diaphragm (42) mounted within the housing structure between said intermediate rigid wall and said speaker means, to form a variable volume air chamber (44) communicating with the speaker means and a variable volume water chamber (46) communicating with the rigid wall;

electrical conductor means interconnecting said microphone means and said speaker means;

and port means (47) in the housing structure for admitting water into said water chamber whereby the water pressure is applied through the air chamber to the inner surface of the vibratable membrane.

2. The communication device of claim 1 wherein said electrical conductor means includes a flexible electrical cable (32) extending from said rigid wall through said diaphragm.

3. The communication device of claim 2 wherein said electrical cable extends through a central point on said diaphragm.

4. The communication device of claim 2 wherein said flexible electrical cable includes a first coiled section in said air chamber and a second coiled section in said water chamber.

5. The communication device of claim 1, and further comprising an opening (14) in said first end of the housing structure adapted to fit around a person's mouth, said microphone means including a second membrane (at 16) within the housing structure in fluid communication with said opening.

6. The communication device of claim 5 and further comprising an electrical power source (26) for the microphone means and speaker means; said electrical power source being located between said rigid wall and said second membrane.

* * * * *